US007162168B2

(12) United States Patent
Kunimori

(10) Patent No.: US 7,162,168 B2
(45) Date of Patent: Jan. 9, 2007

(54) FIXING APPARATUS

(75) Inventor: Osamu Kunimori, Tokyo (JP)

(73) Assignee: Oki Data Corporation, Tokyo (JP)

( * ) Notice: Subject to any disclaimer, the term of this patent is extended or adjusted under 35 U.S.C. 154(b) by 74 days.

(21) Appl. No.: 10/924,920

(22) Filed: Aug. 25, 2004

(65) Prior Publication Data

US 2005/0047809 A1 Mar. 3, 2005

(30) Foreign Application Priority Data

Aug. 28, 2003 (JP) ..... 2003-304409

(51) Int. Cl.
*G03G 15/00* (2006.01)

(52) U.S. Cl. ..... 399/45; 399/328; 399/335

(58) Field of Classification Search ..... 399/45, 399/329, 320, 328, 330, 335
See application file for complete search history.

(56) References Cited

U.S. PATENT DOCUMENTS 5,907,745 A * 5/1999 Azuma et al. ..... 399/92
6,185,383 B1 * 2/2001 Kanari et al. ..... 399/45

FOREIGN PATENT DOCUMENTS

JP 08-006408 1/1996
JP 08137306 A * 5/1996
JP 2001-265157 9/2001

* cited by examiner

*Primary Examiner*—David M. Gray
*Assistant Examiner*—Geoffrey T Evans
(74) *Attorney, Agent, or Firm*—Rabin & Berdo, PC

(57) ABSTRACT

A fixing apparatus includes a magnetic flux generator that generates a magnetic flux. A heater is disposed in the magnetic flux and generates heat by electromagnetic induction to heat a toner image on a medium. A cylindrical selector selects a dimension of the heater in accordance with the width of the medium that extends in a traversing direction perpendicular to the advance direction of the medium. The heater may include at least two heater elements having different lengths that extend in directions substantially perpendicular to the advance direction. The selector selects one of the heater elements in accordance with the width of the medium. The heater may be trapezoidal and mounted on a circumferential surface of the selector, having a width that monotonically increasing in a circumferential direction of the selector. The cylinder rotates to a position where the heater just covers a toner image on the medium.

14 Claims, 13 Drawing Sheets

FIXING APPARATUS

BACKGROUND OF THE INVENTION

1. Field of the Invention

The present invention relates to a fixing apparatus in which a toner image is fused by heat produced by electromagnetic induction.

2. Description of the Related Art

A conventional image-forming apparatus that uses toner to form images performs an electrophotographic image-forming process such as electrophotography, electrostatic recording, and magnetic recording. A toner image is transferred directly or indirectly onto a surface of a print medium and then the toner image is subsequently fused by heat. A fixing unit for this purpose incorporates a pressure roller and a metal fixing roller. A halogen lamp is used as a heat source that heats the metal fixing roller to a predetermined temperature. When a print medium passes a nip formed between the fixing roller and the pressure roller, the toner image is fused by heat to the print medium. In this case, because the fixing roller has a large heat capacity, a long time is required for heating the fixing roller to a predetermined temperature. Another type of fixing apparatus is one in which one surface of a thin film is in contact with a heat source such as a ceramic heater having a small heat capacity and the other surface of the thin film is in contact with the print medium. The thin film has small heat capacity, good heat-resistance, and excellent heat conduction. This configuration allows a quick start of the fixing apparatus, thereby permitting a saving of power of the image-forming apparatus and preventing an increase in interior temperature of the image-forming apparatus.

Still another type of fixing apparatus uses a heater of electromagnetic induction type. An electromagnetic induction type fixing apparatus supplies joule heat, generated by an eddy current that flows in a heating element, to a print medium to fuse a toner image.

FIG. 19 illustrates an example of a conventional apparatus employing an electromagnetic heater element. A magnetic flux generator 3 generates a time-varying magnetic flux. The magnetic flux causes an eddy current by electromagnetic induction and the eddy current generates heat. A heater element 2 is inscribed in a film-like fixing roller having a low heat capacity. The toner 5 transferred onto a print medium 6 passes through a nip formed between the fixing roller 1 and a pressure roller 7. The toner 5 receives heat from the heater element 2 through the fixing roller 1 to be fused to the print medium 6. A non-contact type temperature sensor 4 detects the temperature at the nip.

FIGS. 20A and 20B are cross-sectional views of the conventional fixing apparatus when it is seen from an upstream side of the fixing apparatus with respect to the direction of travel of the print medium. For ease of explanation of heat distribution on the fixing roller 1, the pressure roller 7 is not shown in FIGS. 20A and 20B. The heater element has a width that is enough to evenly fix a toner image on a maximum-width print medium 6*b*. The temperature sensor 4 is in contact with the heater element 2 and disposed in a longitudinal direction substantially at a center of the nip, thereby reliably detecting the temperature of the heater element 2 regardless of which one of a minimum-width print medium 6*a* and a maximum-width print medium 6*b* passes through the nip.

FIG. 20A illustrates the temperature profile on the fixing roller 1 when the maximum-width print medium passes the nip. FIG. 20B illustrates the temperature profile on the fixing roller 1 when the minimum-width print medium passes the nip. In accordance with the temperature detected by the temperature sensor 4, a CPU 10 controls a power supply 9 to maintain the nip area at a predetermined temperature. The heater element 2 is designed to generate heat so that when the maximum-width print medium 6*a* passes through the nip, the toner image on the maximum-width print medium 6*a* can be fused evenly. The heater element 2 generates an amount of heat uniformly distributed along the length of the heater element 2. Therefore, when the print medium 6 having a smaller width than the maximum-width print medium 6*a* passes through the nip, heat is also generated in areas H of the heater not in contact with the print medium 6. However, the heat generated in the areas H is not transmitted to the print medium 6 and the toner image on the print medium 6.

As a result, the temperature is higher at the areas of the heater element 2 not in contact with the print medium 6 than at the areas in contact with the print medium 6.

The heat generated at the areas H causes an excess increase in temperature in the apparatus, which in turn shortens the lifetime of the pressure roller and the film-like fixing roller. This is also detrimental from a point of view of energy saving.

SUMMARY OF THE INVENTION

A fixing apparatus includes a magnetic flux generator, a heater, and a selector. The magnetic flux generator generates a magnetic flux. The heater is disposed in the magnetic flux and generates heat by electromagnetic induction to heat a developer on a print medium. The selector selects a dimension of the heater in accordance with a size of the print medium.

The heater includes at least two heater elements having different lengths that extend in traversing directions substantially perpendicular to an advance direction in which the print medium is advanced. The size of the print medium is a width of the print medium that extends in the traversing direction. The selector selects one of the at least two heater elements in accordance with the width of the print medium.

The fixing apparatus further includes a fixing member that is a hollow cylinder that rotates in contact with the print medium. The magnetic flux generator and the heater are disposed inside of the fixing member in such a way that the heater is between the fixing member and the magnetic flux generator.

The fixing apparatus further includes a pressurizing member formed of a non-magnetic, electrically conductive material. The pressurizing member opposes the fixing member in such a way that the print medium is held between the pressurizing member and the fixing member in a sandwiched relation.

The heater is formed on a circumferential surface of a cylindrical rotating body that rotates about an axis substantially parallel to a traversing direction perpendicular to an advance direction in which the print medium is advanced. The heater has a dimension that extends in the traversing direction, the dimension monotonically increasing or decreasing along a circumferential direction of the cylindrical rotating body. The heater is supported on the rotating body by means of a non-magnetic, electrically conductive member.

When the magnetic flux generator generates the magnetic flux, a first current flows into the magnetic flux generator. When the magnetic flux generator dos not generate the magnetic flux, a second current flows into the magnetic flux generator. The heater is positioned relative to the magnetic flux generator based on a difference between the first current and the second current.

A printer having the fixing apparatus includes:

a photoconductive drum;

a charging roller that rotates in contact with the photoconductive drum to charge a surface of the photoconductive drum;

an LED head that illuminates the charged surface of the photoconductive drum to form an electrostatic latent image on the charged surface;

a developing roller that rotates in contact with the photoconductive drum to develop the electrostatic latent image into a visible image; and a transfer roller that transfers the visible image onto a print medium;

wherein the print medium is advanced to the fixing apparatus after transfer of the visible image onto the print medium so that the visible image is fixed into a permanent image.

A fixing apparatus includes a magnetic flux generator, a heater, and a selector. The magnetic flux generator generates a magnetic flux. The heater is disposed in the magnetic flux and generates heat by electromagnetic induction to heat a toner image formed on a print medium. The selector selects a dimension of the heater in accordance with a size of the print medium. The selector selects the dimension of the heater element in such a way that a heat-generating portion of the heater extends across a width of a print region of the print medium in which a toner image should be printed, the heat-generating portion extending in a traversing direction substantially perpendicular to an advance direction in which the print medium is advanced.

The heater includes at least two heater elements having different lengths that extend in the traversing direction. The size of the print medium is a width of the print medium that extends in the traversing direction and the selector selects one of the at least two heater elements in accordance with the width of the print region that extends in the traversing direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

Figure 1:
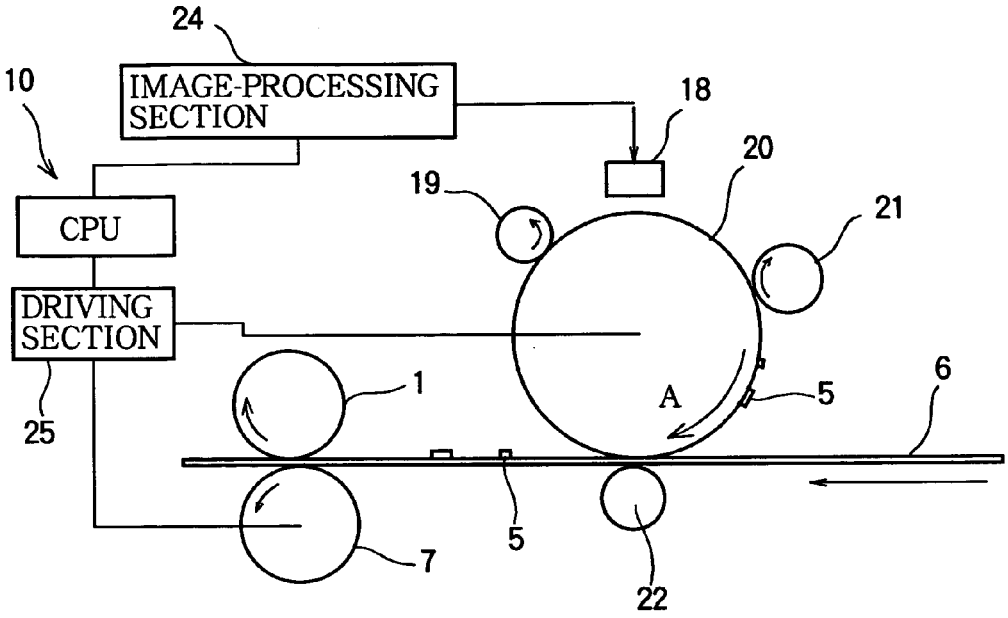
FIG. 1 illustrates a general configuration of a first embodiment.

FIG. 1 illustrates a general configuration of a first embodiment. The operation of the image forming apparatus from the activation of printing until toner 5 is transferred onto a print medium 6 will be described.

A driving section 25 drives the photoconductive drum 20, a fixing roller 1, and a pressure roller 7 in rotation. When a photoconductive drum 20 rotates in a direction shown by arrow A, a charging roller 19 rotates in contact with the photoconductive drum 20 to charge the surface of the photoconductive drum 20 to a negative potential. A dot image outputted from an image-processing section 24 drives an LED head 18 to illuminate the charged surface of the photoconductive drum 20. The potential of exposed areas on the photoconductive drum 20 becomes nearly zero volts. The LED head 18 extends in a direction parallel to a rotational axis of the photoconductive drum 20 and therefore forms a line-shaped electrostatic latent image on the surface of the photoconductive drum 20. As the photoconductive drum 20 rotates, the LED head 18 forms line-shaped electrostatic latent images one after another on the photoconductive drum 20, so that the line-shaped electrostatic latent images form an entire electrostatic latent image for one page as a whole.

A developing roller 21 rotates in contact with the photoconductive drum 20. The developing roller 21 has a thin layer of toner formed on its circumferential surface. The toner on the developing roller 21 is attracted to the exposed areas or an electrostatic latent image on the photoconductive drum 20 by the Coulomb force to form a toner image. As the photoconductive drum 20 rotates further, the toner image reaches a transfer point where the transfer roller 22 receives a positive voltage and transfers the toner onto the print medium 6. Then, the print medium 6 leaves the transfer point and then enters a fixing apparatus where the toner image on the print medium 6 is fused into a permanent image.

The image-processing section 24 has an expansion section that expands print data received from a host apparatus into a dot image for one page of print medium. The dot image for one page corresponds to the entire image area for complete one page of print medium 6. The dot image is stored into a dot-image memory. A width-to-be-heated memory stores a width of the print medium 6 to be heated. The width of an area on the print medium 6 to be heated corresponds to a longitudinal length of the heater 2.

Figure 2:
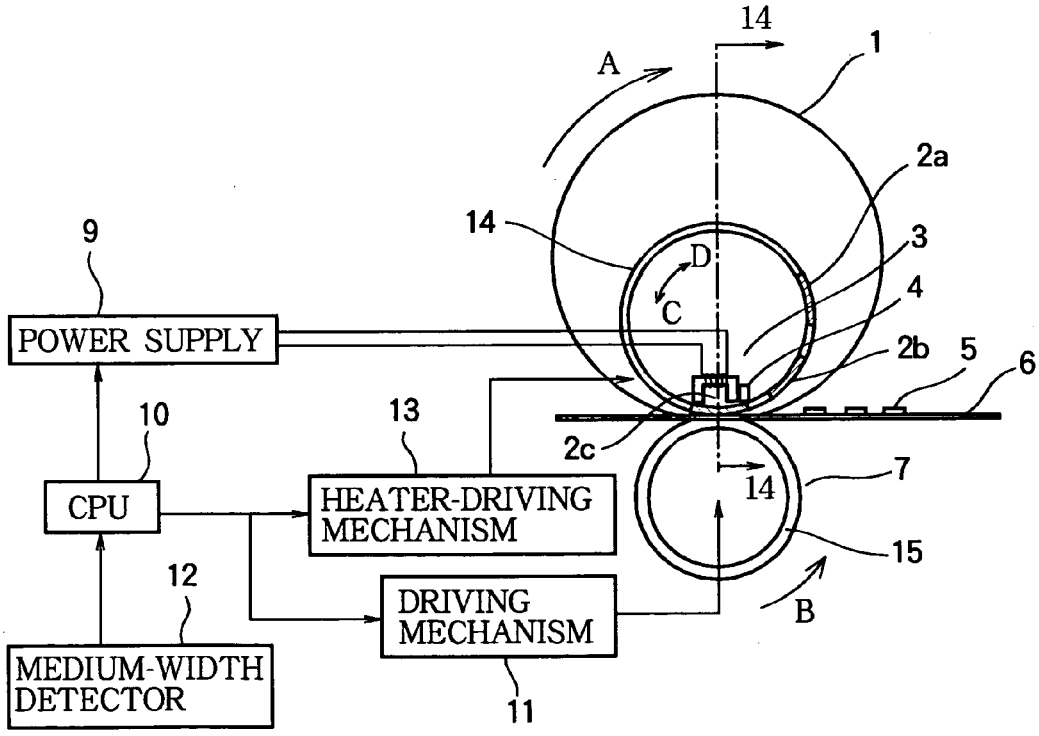
FIG. 2 is a schematic view of a configuration of a fixing apparatus according to the first embodiment.
Figure 19:
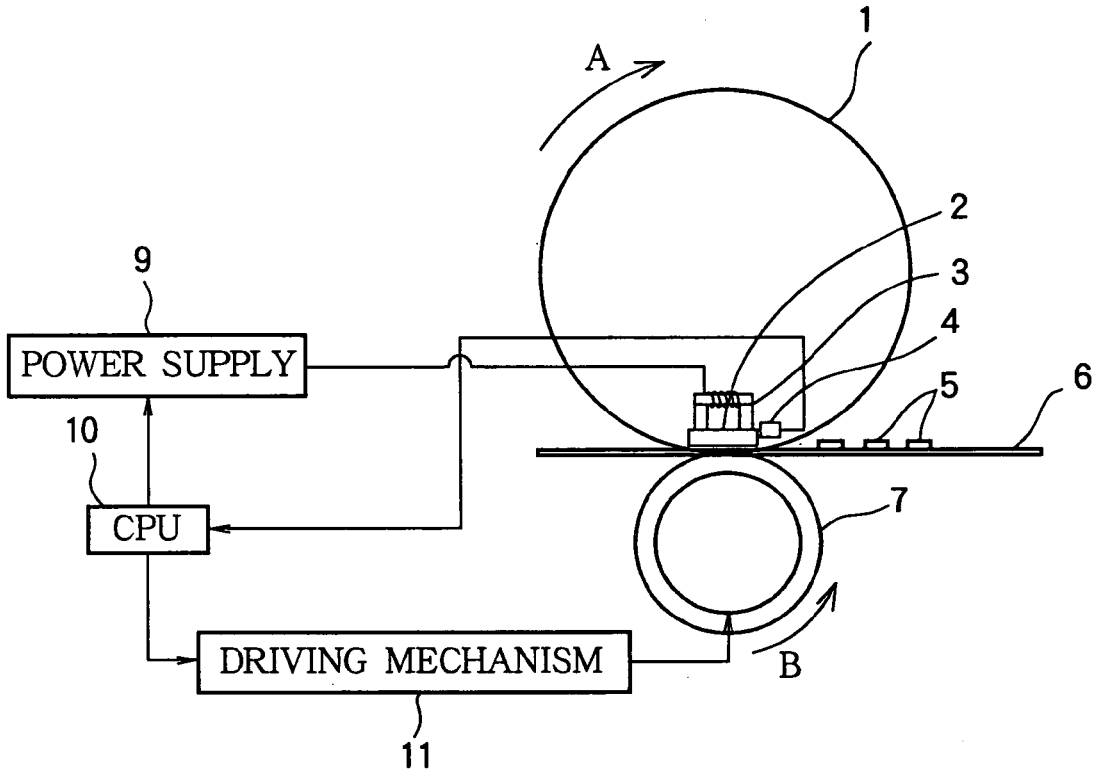
FIG.19 PRIOR ART
FIG. 19 illustrates an example of a conventional apparatus employing an electromagnetic heater element.
Figure 20A:
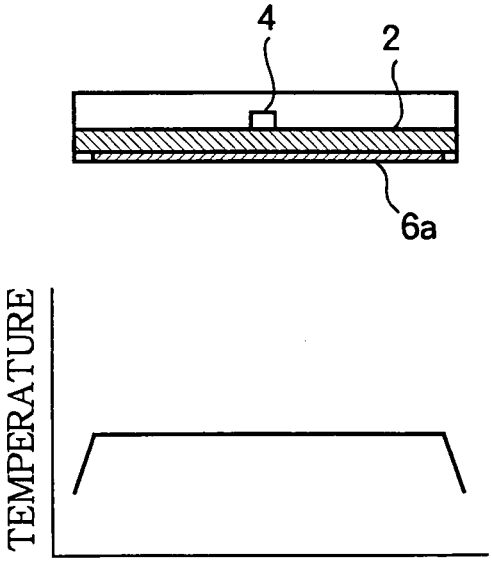
FIG.20A PRIOR ART
FIGS. 20A and 20B are cross-sectional views of the conventional fixing apparatus when it is seen from a longitudinal direction.
Figure 20B:
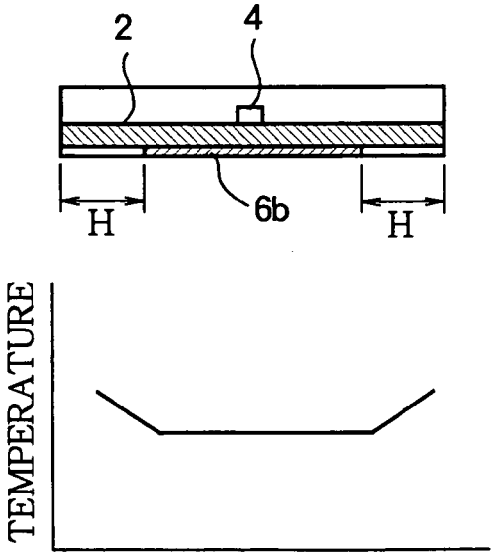
FIG.20B PRIOR ART

FIG. 2 is a schematic view of a configuration of the fixing apparatus according to the first embodiment. This fixing unit is of electromagnetic induction type, which is of substantially the same configuration in FIG. 19.

The CPU 10 controls the output power of the power supply 9 that drives the magnetic flux generator 3. The power supply 9 supplies an a-c power to the magnetic flux generator 3 which in turn generates an alternating flux Φ. The power supply 9 has a means for detecting the a-c current supplied to the magnetic flux generator 3. The CPU 10 selects an appropriate one of heater elements 2*a*, 2*b*, and 2*c* of a heater element 2 in accordance with the output of a medium-width detector 12 that detects the width of the print medium 6. The medium-width detector 12 takes the form of, for example, a size-detecting switch or a detector disposed in a transport path in which the print medium 6 is fed and transported.

A driving mechanism 11 transports the print medium 6 and drives the pressure roller 7 and fixing roller 1 in rotation, so that the print medium 6 passes through a nip formed between the fixing roller 1 and the pressure roller 7. Before the print medium 6 with the toner deposited thereon passes through the nip, the CPU 10 detects the width of the print medium 6 and selects an appropriate one from the heater elements 2*a*, 2*b*, and 2*c*, i.e., a heater element is as long as the print medium 6 is wide. In other words, the CPU 10 supplies current to the magnetic flux generator 3 while at the same time causing a selector-driving mechanism 13 to drive a selector roller 14 to rotate, so that the appropriate one of the heater elements opposes the generator 3. At this moment, the CPU 10 monitors the current flowing into the magnetic flux generator 3.

The selector-driving mechanism 13 takes the form of, for example, a pulse motor and is coupled to the shaft of the selector roller 14. The amount of rotation of the selector roller 14 from a predetermined reference position to a rotational position corresponds to the number of pulses required to rotate the selector roller 14 from the predetermined reference to the rotational position. Thus, the amount of rotation of the selector roller 14 can be determined by counting the number of pulses supplied to the selector-driving mechanism 13, thereby positioning the respective heater elements 2*a*, 2*b*, and 2*c* accurately. The magnetic reluctance of the heater elements 2*a*, 2*b*, and 2*c* varies depending on the length of the heater element. The aluminum material for the selector roller 14 differs in magnetic reluctance from the heater elements 2*a*, 2*b*, and 2*c*. Thus, the heater elements 2*a*, 2*b*, and 2*c* can be accurately positioned even though a portion of the selector roller 14 is between the magnetic flux generator 3 and the fixing roller 1.

When the image-forming apparatus is at its standby state, if continuous printing is activated, temperature control is performed by using a non-contact type temperature sensor 4 in the form of a thermistor disposed in the longitudinally middle of the fixing roller 1.

Figure 3:
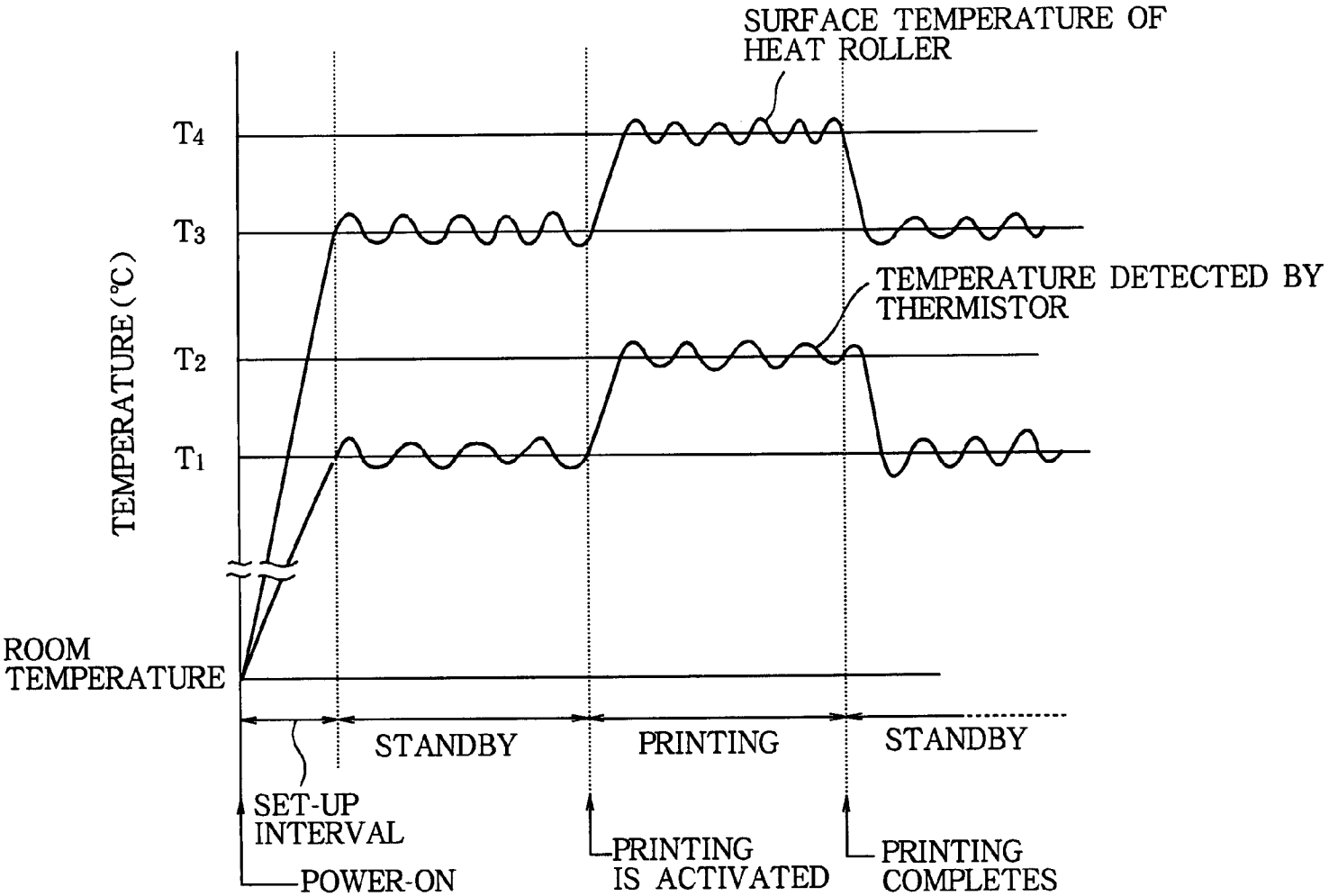
FIG. 3 illustrates temperature control by the use of a temperature sensor.

FIG. 3 illustrates temperature control by the use of the temperature sensor 4. Upon receiving a print command that activates printing, the CPU 10 starts temperature control based on the output of the temperature sensor 4. The CPU reads a program for controlling the fixing temperature, the program being suitable for a particular size of print medium from a program ROM. Then, the CPU sends the program for controlling the fixing temperature to the power supply 9. Then, the target temperature is increased to a temperature T2 higher than a temperature T1 detected by the temperature sensor 4, so that the surface temperature of the fixing roller 1 increases. After the surface temperature of the fixing roller 1 has reached the temperature T2, the temperature control is carried on using the temperature T2 as a target temperature. The temperature of the surface of the fixing roller 1 in the longitudinally middle of the fixing roller 1 increases from a standby temperature T3 to a temperature T4, and therefore the temperature control is performed in such a way that the surface temperature of the fixing roller 1 changes back and forth through the temperature T4 within a predetermined range.

In order to ensure good fixing performance of the fixing apparatus, the surface temperature preferably will have reached the temperature T4 by the time that the leading end of the print medium 6 arrives at the fixing roller 1. For this purpose, it is desired that the time required for the surface temperature to reach the temperature T2 after activation of printing is substantially equal to or shorter than the time required for the leading end of the print medium 6 to arrive at the fixing roller 1 after activation of printing.

During printing, the temperature sensor 4 constantly detects the temperature of an area on the surface of the fixing roller 1 through which the print medium 6 passes. Thus, the temperature T4 can be maintained reliably.

The heater elements 2*a*, 2*b*, and 2*c* are mounted on the cylindrical surface of the selector roller 14, being aligned at a predetermined intervals in the circumferential direction of the selector roller 14. The heater elements 2*a*, 2*b*, and 2*c* are different in length and extend in directions parallel to a rotational axis X—X of the selector roller 14.

Under the control of the CPU 10, the selector-driving mechanism 13 drives the selector roller 14 to rotate, so that an appropriate one of the heater elements 2*a*, 2*b*, or 2*c* is selectively positioned relative to the print medium 6. In other words, when the selector roller 14 rotates by an appropriate amount of rotation either in the C direction or in the D direction, a selected one of the heater elements 2*a*, 2*b*, and 2*c* is positioned between the magnetic generator 3 and the fixing roller 1, so that the selected heater element is in a magnetic flux generated by the magnetic flux generator 3. The fixing roller 1 rotates at a circumferential speed equivalent to a transport speed of the print medium 6 in such a manner that the toner image on the print medium 6 is not damaged. The selector roller 14 has flanges 14*a* at both end portions, the flanges 14*a* preventing the fixing roller 1 from drifting in an axial direction.

The fixing roller 1 includes a resin layer formed of a heat-resistant film such as polyimide, which has excellent heat transfer properties and heat resistance. The surface of the fixing roller 1 is covered with, for example, fluoroplastic that decreases fiction coefficient and improves removal of toner. An endless belt, which is thin and can be deformed easily, may be used in place of the fixing roller 1. The belt can deform in accordance with the shape of the surface of the induction heater 2 and the print medium 6, thereby transferring heat to the print medium 6 efficiently. The temperature sensor 4 is located in a longitudinal direction substantially at a center of the heater elements 2*a*–2*c* and is in contact with a portion of the heater elements 2*a*–2*c* near the magnetic flux generator 3. The pressure roller 7 that cooperates with the fixing roller 1 may be of any configuration and may be formed of any material.

Figure 4:
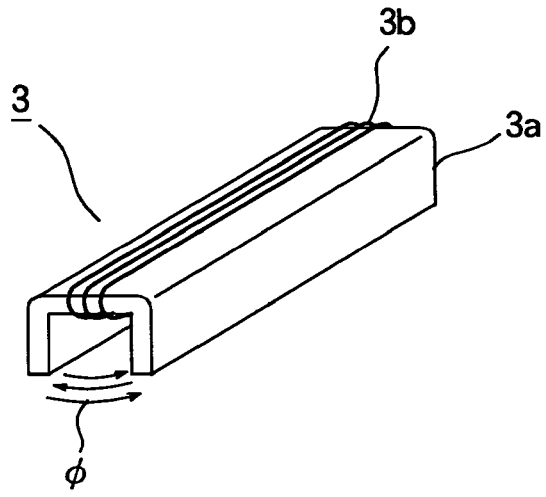
FIG. 4 is a perspective view illustrating a magnetic flux generator.

FIG. 4 is a perspective view illustrating the magnetic flux generator 3. The magnetic flux generator 3 is in the form of a U-shaped ferrite core 3*a* around which a coil 3*b* is wound.

Figure 5:
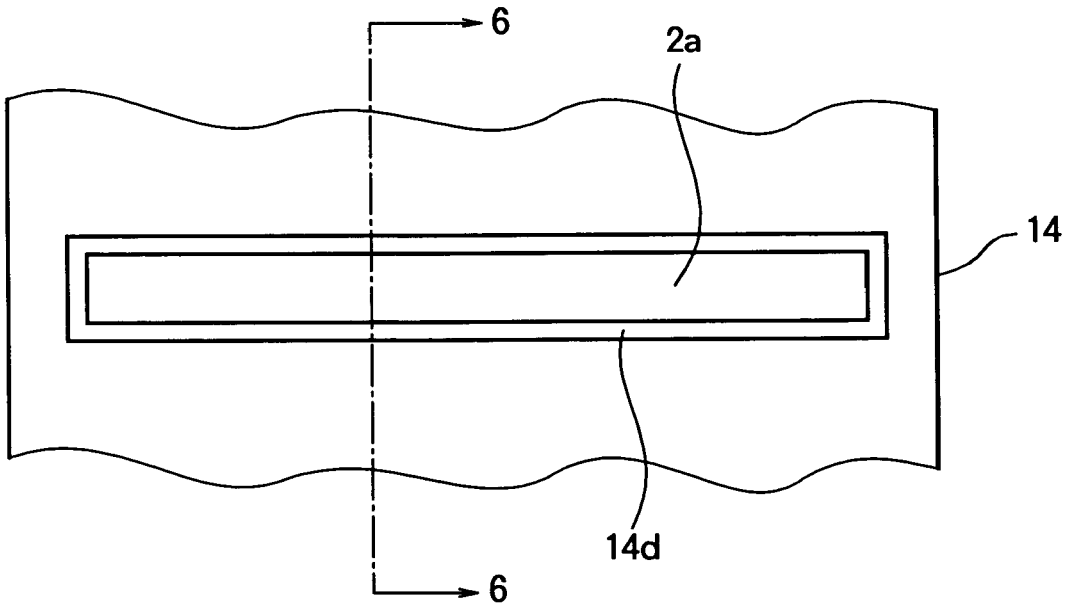
FIG. 5 illustrates a heater element mounted on a selector roller.

FIG. 5 illustrates the heater element 2*a* mounted on the selector roller 14.

Figure 6:
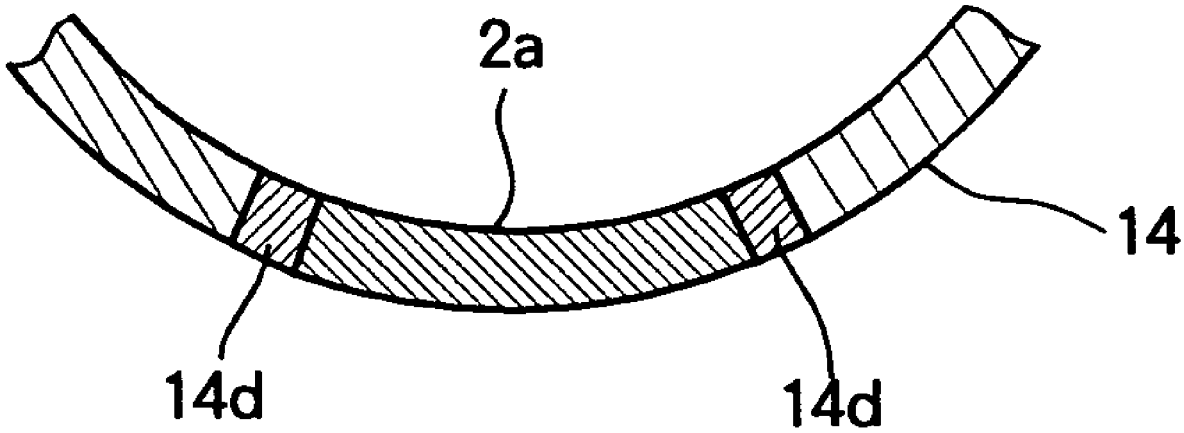
FIG. 6 is a cross-sectional view taken along line 6—6 of FIG. 5.

FIG. 6 is a cross-sectional view taken along line 6—6 of FIG. 5.

Referring to FIGS. 5 and 6, the heater elements 2*a*, 2*b*, and 2*c* are securely mounted on the selector roller 14 by means of a holding member 14*b*. The holding member 14*b* is made of a heat-resistant material such as glass, glass wool, various types of ceramics, and refractory brick that has low heat transfer property, and prevents heat from transferring from the heater element to the surroundings.

Figure 7A:
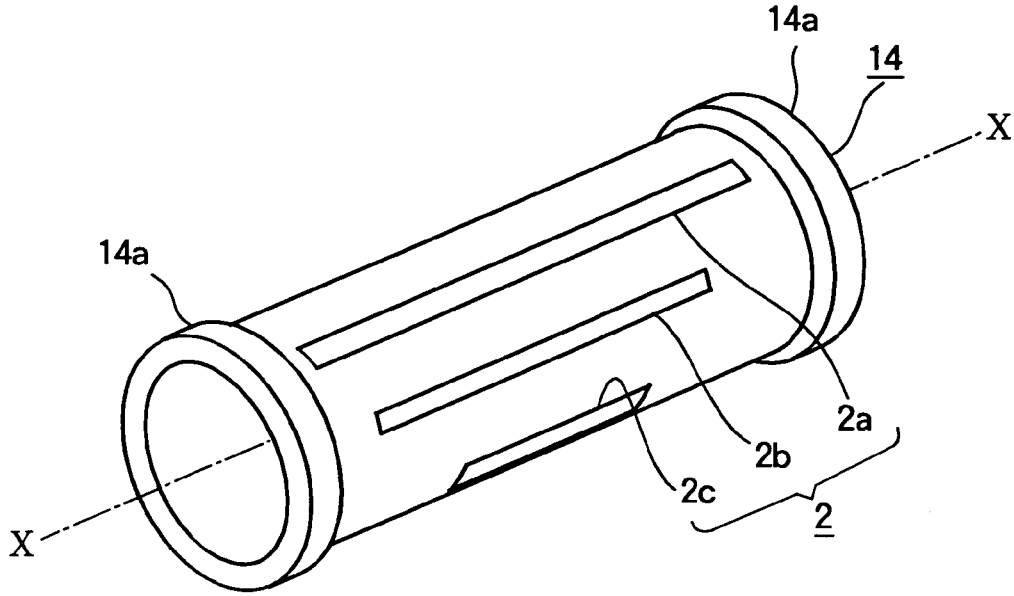
FIGS. 7A and 7B are perspective views illustrating the selector roller of FIG. 2.
Figure 7B:
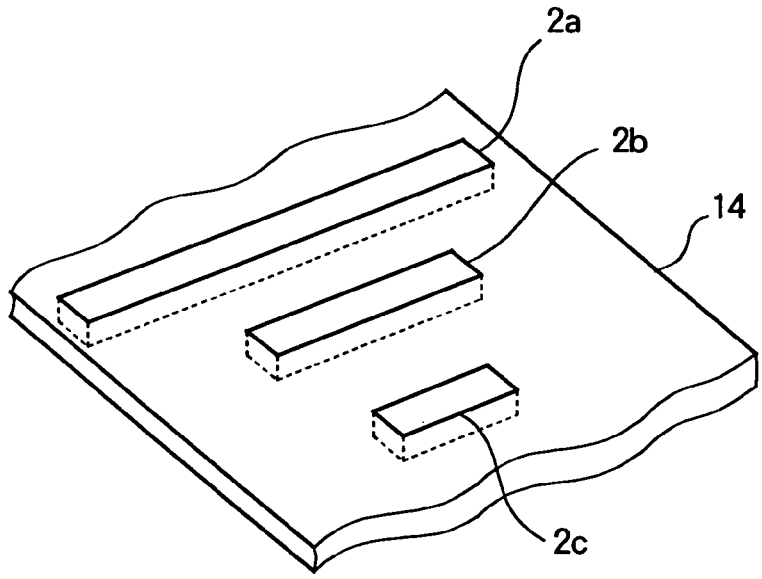

FIGS. 7A and 7B are perspective views illustrating the selector roller 14 of FIG. 2. FIG. 7B illustrates the cylindrical selector roller 14 when it is "expanded" from a three-dimensional cylinder into a two-dimensional "flat sheet". The heater elements 2*a*, 2*b*, and 2*c* are embedded into the selector roller 14 such that the heater elements 2*a*, 2*b*, and 2 are substantially flush with the circumferential surface of the selector roller 14. Thus, the outer surface of the selector roller 14 is substantially a smooth cylindrical surface. The heater elements 2*a*, 2*b*, and 2 are formed of a material such as iron, nickel or SVS430 having electric loss that causes self-heating, so that the eddy current developed by electromagnetic induction flows in the heater elements to generate joule heat. The selector roller 14 is made of a non-magnetic material (copper, aluminum, silver, or alloys that contain these metals) that has low resistivity to allow induction current to flow. When a selected one of the heater elements 2*a*, 2*b*, and 2*c* is positioned between the magnetic flux generator 3 and the fixing roller 1, the selected heater element directly faces the magnetic flux generator 3 and the fixing roller 1.

Figure 8:
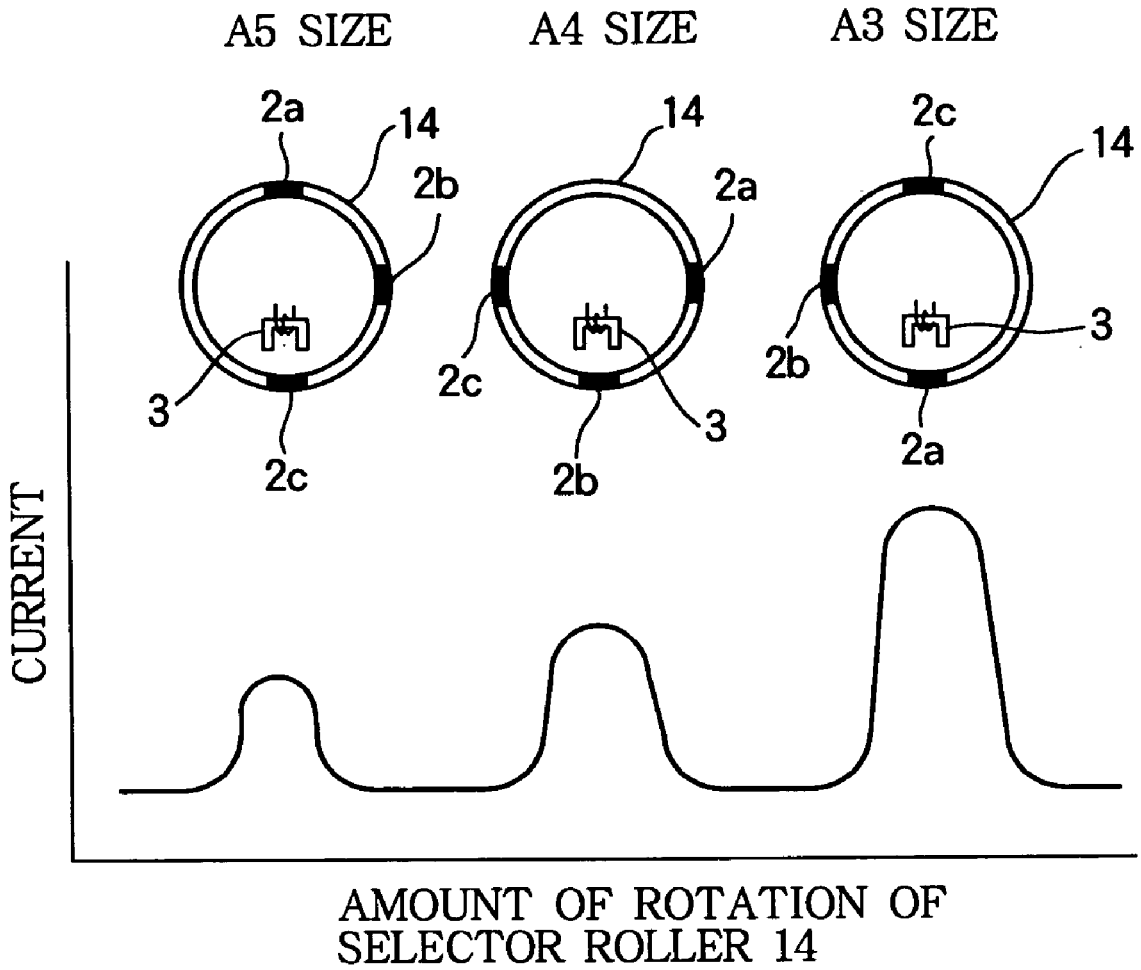
FIG. 8 illustrates changes in the current that flows through the magnetic flux generator when the selector roller is rotated.

FIG. 8 illustrates changes in current that flows through the magnetic flux generator 3 for three different sizes of print medium, i.e., A5, A4, and A3 size paper, when the selector roller 14 is rotated. When a portion of the selector roller 14 made of aluminum faces the magnetic flux generator 3, the current is small. When the heater element faces the magnetic flux generator 3, the current is large. In other words, the longer the length of the heater element, the larger the current. Thus, the positional relation between the heater elements 2*a*, 2*b*, and 2*c* mounted on the selector roller 14 and the magnetic flux generator 3 can be accurately determined by using the change in current as the selector roller 14 rotates.

Figure 9A:
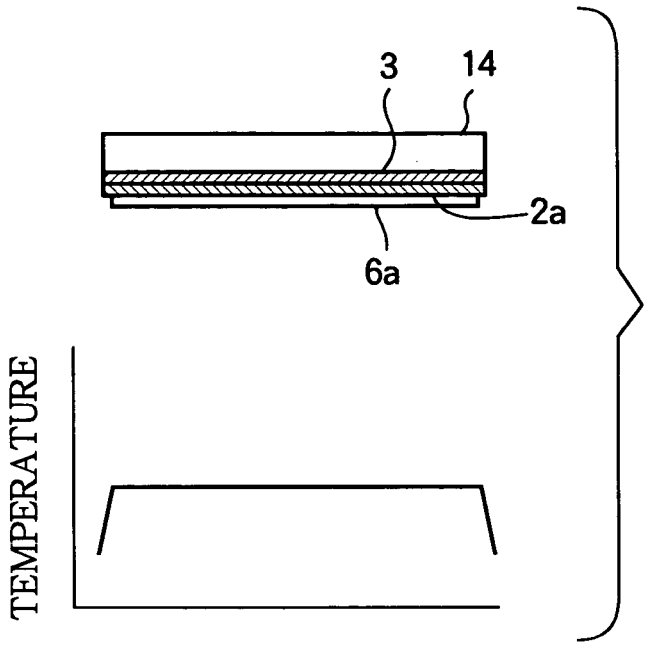
FIG. 9A and FIG. 9B illustrate the temperature profile along the length of the fixing roller according to the first embodiment.
Figure 9B:
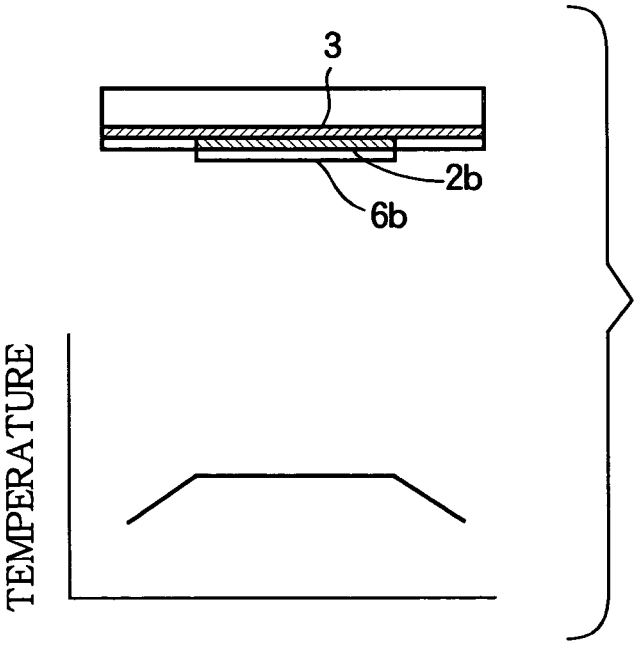

FIG. 9A and FIG. 9B illustrate the temperature profile along the length of the fixing roller 1 according to the first embodiment. FIG. 9A illustrates when the print medium 6*a* has a large width. FIG. 9B illustrates when the print medium 6*b* has a small width.

According to the first embodiment, heat is generated only in an area having a length substantially equal to the width of the print medium, and little or no heat is transferred to the surrounding areas. Therefore, this configuration prevents an unwanted increase in temperature in the area through which the print medium does not pass, and prolonging the lifetime of, for example, the pressure roller 7 as well as achieving energy saving.

Figure 10:
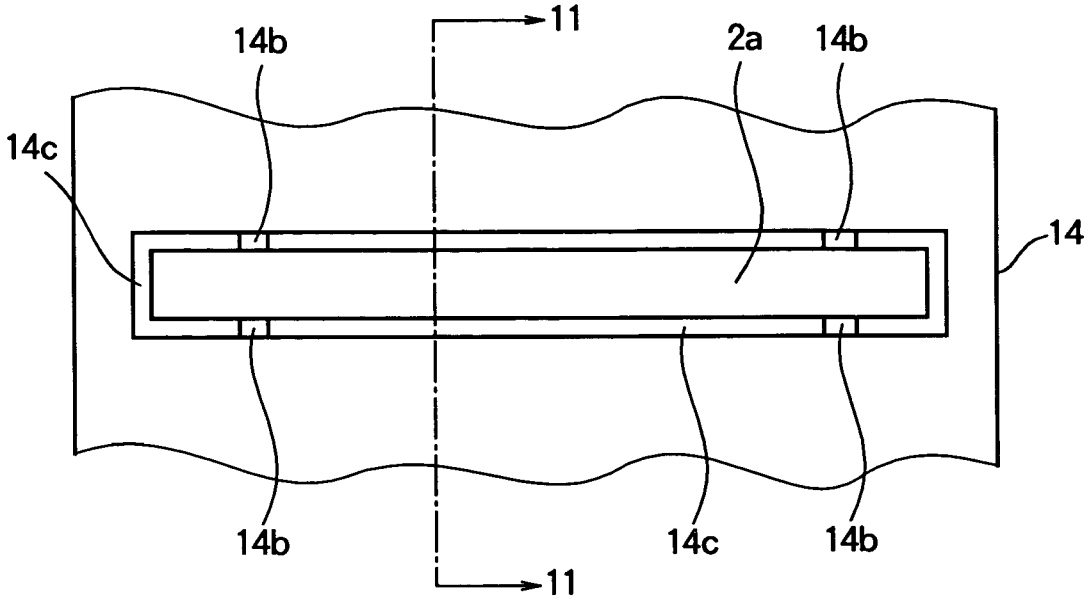
FIG. 10 illustrates a modification to a holding member that holds heater elements in position on the selector roller.
Figure 11:
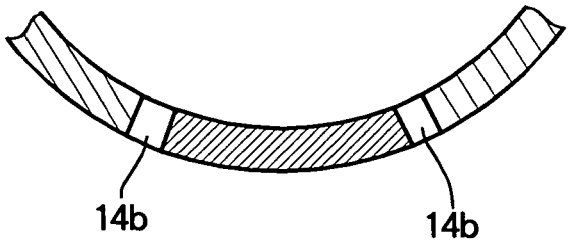
FIG. 11 is a partial cross-sectional view taken along line 11—11 of FIG. 10.

FIG. 10 illustrates a modification to the holding member 14*b* that securely holds the heater elements in position on the selector roller 14. FIG. 11 is a partial cross-sectional view taken along line 11—11 of FIG. 10. The structure in FIG. 10 is to prevent the heat generated by magnetic induction from being lost to the adjacent heater elements. In other words, an air gap 14*c* is provided between the heater element (heater element 2*a* is shown in FIG. 10) and the selector roller 14, and the heater element is secured at, for example, four locations by means of the holding member 14*b*.

Second Embodiment

Figure 12A:
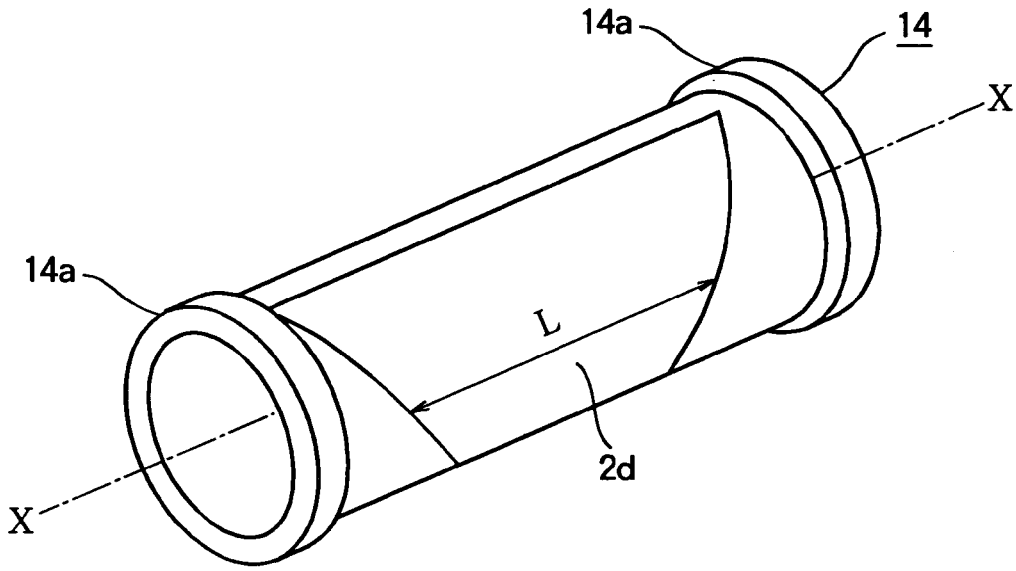
FIG. 12A is a perspective view illustrating a heater element according to a second embodiment.
Figure 12B:
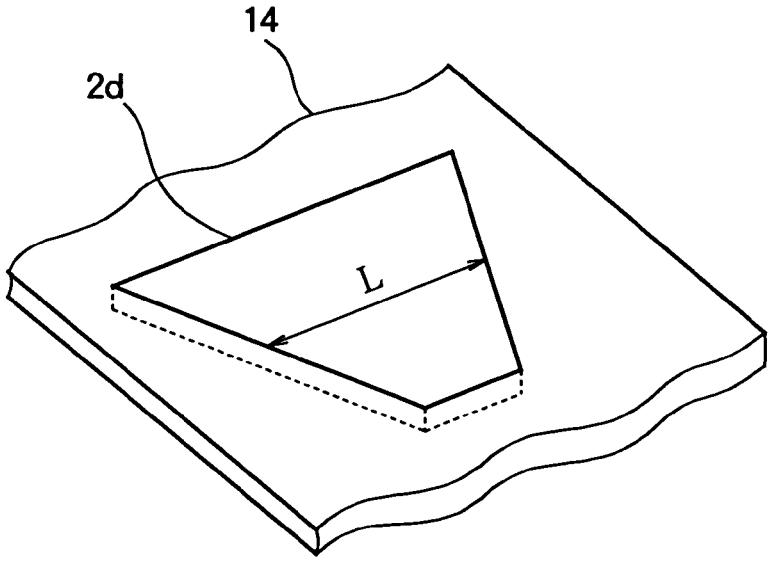
FIG. 12B is a perspective view of the heater element of FIG. 12A when the heater element is "expanded" from a three-dimensional shape into a two-dimensional shape (a flat plate)

FIG. 12A is a perspective view illustrating an induction heater 2*d* according to a second embodiment. FIG. 12B is a perspective view of the induction heater 2*d* of FIG. 12A when the induction heater 2*d* is "expanded" into a "flat plate." While the first embodiment uses more than two discrete heater elements (2*a*, 2*b*, and 2*c*) of different lengths, the second embodiment employs a single heater element 2*d* having a monotonically decreasing or increasing width in a circumferential direction of the selector roller 14. That is, the induction heater 2*d* is trapezoidal when it is expanded into a flat plate. Consequently, as the selector roller 14 rotates, a portion of the induction heater 2*d* sandwiched between the magnetic flux generator 3 and the fixing roller 1 varies continuously in a dimension L (FIG. 12) extending parallel to the rotational axis of the fixing roller 1.

The image-forming apparatus may have an operation section through which the user inputs the type of print medium, and a memory that stores medium-width data. When the user inputs the type of print medium, an appropriate size of heater element may be selected from the medium-width data. The rest of the configuration of the second embodiment is the same as the first embodiment.

The operation of the second embodiment will be described. Prior to initiation of printing, the user selects a width of print medium through a medium-width inputting section, not shown. A CPU 10 causes the selector roller 14 to rotate to position the selector roller 14 at a rotational position where the induction heater can just cover the width of the print medium. In other words, just as in the first embodiment, the CPU 10 detects the current supplied to the magnetic flux generator 3 while also causing the selector roller 14 to rotate. When an aluminum portion of the selector roller 14 enters the magnetic flux generated by the magnetic flux generator 3, the current flowing through the magnetic flux generator 3 abruptly decreases. This abruptly decreased current is stored as an initial current. Based on this initial current, a drive mechanism in the form of a pulse motor rotates by a predetermined amount of rotation to set the selector roller 14 at a desired rotational position.

Figure 13:
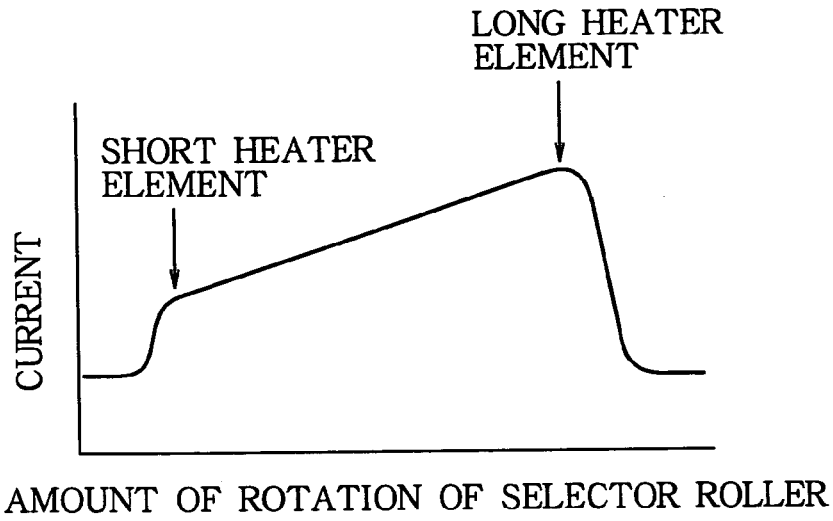
FIG. 13 illustrates the current supplied to the magnetic flux generator of FIG. 12A when the selector roller is rotated.

FIG. 13 illustrates the current supplied to the magnetic flux generator 3 when the selector roller 14 is rotated. The longer the effective length of the induction heater, the larger the current. Therefore, the rotational position of the selector roller 14 at which the induction heater is absent from the magnetic flux can be first determined from the change in current supplied to the magnetic flux generator 3, and then an appropriate rotational position of the selector roller 14 can be set. The rest of the construction is the same as the first embodiment so that the position of the heater element 2*d* can be set based on a detection output of a medium-width detector, not shown, similar to that in FIG. 2.

The image-forming apparatus prints not only on print media of regular sizes but also on print media of irregular sizes. The configuration of the second embodiment allows selecting of the effective length L (FIG. 12) of the induction heater, enhancing the advantage of the first embodiment.

Third Embodiment

In the first and second embodiments, the selector roller 14 is formed of aluminum, which is electrically conductive. However, the selector roller 14 may be made of any material provided that the material is non-magnetic. A selector roller 14 according to a third embodiment is made of a plastics material. Although, the first and second embodiments do not address the material of the pressure roller 7, the pressure roller according to the third embodiment includes a roller 17 of aluminum, which is non-magnetic and electrically conductive and is coated with a resilient layer.

Figure 14:
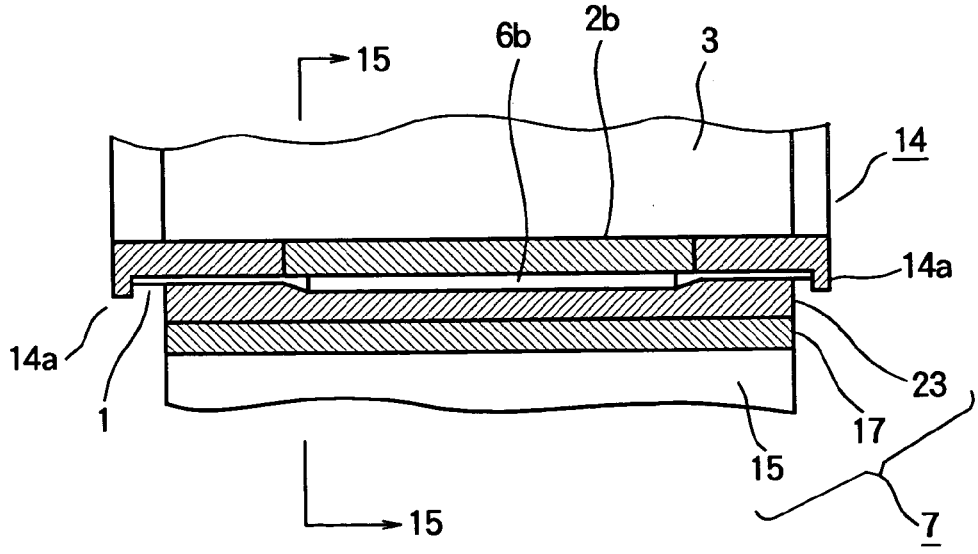
FIG. 14 illustrates a third embodiment and is a cross-sectional view corresponding to that taken along line 14—14 of FIG. 2.

FIG. 14 is a cross-sectional view taken along line 14—14 of FIG. 2, and illustrates a print medium 6*b* having a small width when the print medium 6 passes through the fixing apparatus. The pressure roller 7 has a core 15 on which the roller 17 is formed. The roller 17 is covered with a resilient layer 23 of a low hardness silicone rubber. The roller 17 is formed of preferably a non-magnetic material having a small resistivity that allows induced current to flow. Such a material may be copper, aluminum, silver, or an alloy that contain these metals. The core 15 may be made of the same material as the roller 17. When the print medium 6*b* is sandwiched in a nip formed between the induction heater 2*b* on the selector roller 14 and the resilient layer 23 of the pressure roller 7, the resilient layer 23 is dented by an amount equal to the thickness of the print medium 6*b*, thereby firmly holding the print medium 6*b* between the induction heater 2*b* and the resilient layer 23.

Figure 15:
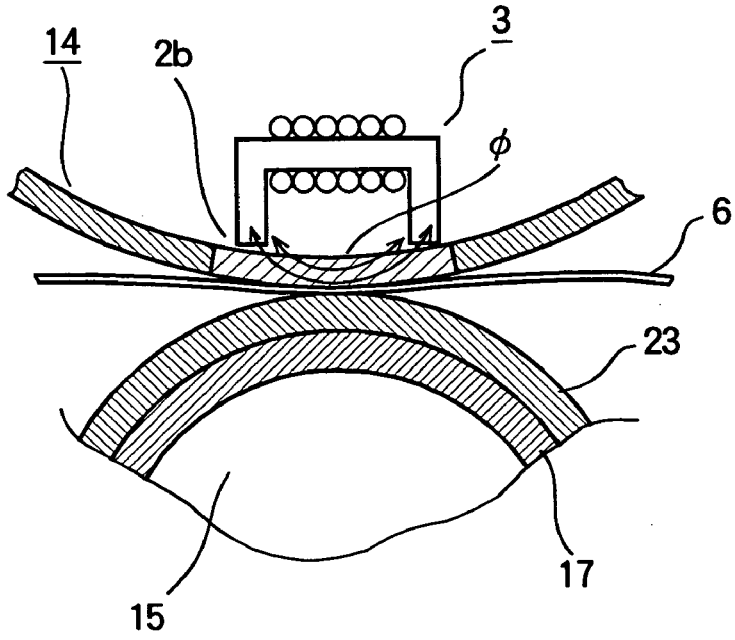
FIG. 15 is a fragmentary cross-sectional view taken along line 15—15 of FIG. 14, FIG. 15 illustrating the heater element when it is in a magnetic flux generated by the magnetic flux generator.

FIG. 15 is a fragmentary cross-sectional view taken along line 15—15 of FIG. 14.

Figure 16:
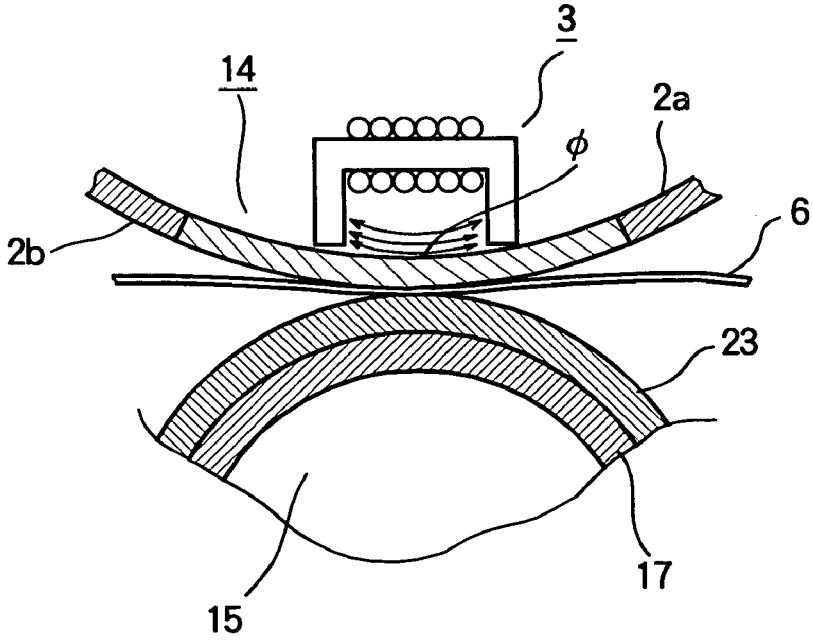
FIG. 16 is a fragmentary cross-sectional view illustrating the selector roller and the roller when the heater element is not in the magnetic flux generated by the magnetic flux generator.

FIG. 16 illustrates the heater elements 2*a* and 2*b* when they are in the magnetic flux generated by the magnetic flux generator 3. The roller 17 is non-magnetic and therefore the magnetic flux does not pass through the roller 17.

FIG. 16 is a fragmentary cross-sectional view illustrating the selector roller 14 and the roller 17 when the heater element 2*b* is not in the magnetic flux generated by the magnetic flux generator 3. The roller 17 opposes the magnetic flux generator 3. Because the roller 17 is non-magnetic, the magnetic flux does not pass through the roller 17, so that heat generation will not occur in the roller 17.

The fixing apparatus according to the third embodiment operates and is controlled in the same manner as the first and second embodiments. In the electromagnetic induction method, an alternating current of more than 10 kHz is supplied to the magnetic flux generator 3. The magnetic flux produced by the alternating current also varies in an alternating manner. When this magnetic flux flows through a material having appropriate electric loss, iron loss including hysteresis loss and eddy current loss causes a considerable amount of heat to be generated. The external magnetic flux flows through a non-magnetic material having a low resistivity to develop eddy current in the non-magnetic material, which in turn generates a magnetic flux in the opposite direction to the external magnetic flux. The magnetic flux due to the eddy current resists the external magnetic flux, thereby preventing the external magnetic flux from flowing through the non-magnetic material. Thus, forming the pressure roller of a non-magnetic material having low resistivity effectively prevents the pressure roller from generating a significant amount of heat even if the external magnetic flux enters the non-magnetic material.

The magnetic flux flows through the heater element 2*b* placed in the magnetic path to generate heat. The roller 17 under the heater element 2*b* serves as a magnetic shielding member that prevents the magnetic flux from entering the surrounding magnetic materials, thereby preventing heat generation by the surroundings. The magnetic flux flows through the roller 17 outside of an area in which the print medium passes, thereby developing an eddy current. This eddy current will not generate a significant amount of heat because aluminum has a low skin resistance.

Fourth Embodiment

A fourth embodiment has substantially the same construction as the first embodiment except that an image-processing section 24 includes a means for detecting a maximum width of an image area that is expanded into a bit map in a memory. The heater element and selector roller 14 may be of the construction in FIGS. 7A and 7B or in FIGS. 12A and 12B.

Figure 17:
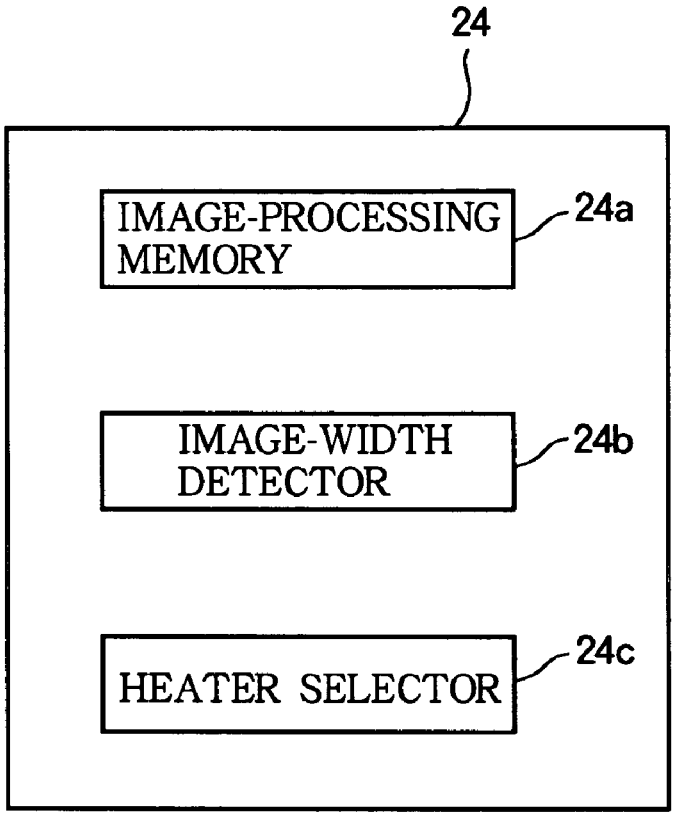
FIG. 17 illustrates a configuration of an image processing section according to a fourth embodiment.

FIG. 17 illustrates a configuration of the image-processing section 24 according to the fourth embodiment. With an electrophotographic image-forming apparatus, print data is expanded into a dot image that corresponds to the entire image area of the print medium 6 before the LED head illuminates the charged surface of a photoconductive drum. The dot image is stored in a dot image memory 24*a*. An image-width detector 24*b* reads the dot image from the dot image memory 24 to detect a maximum dimension of the dot image in a traversing direction perpendicular to an advance direction of the print medium 6. Based on the maximum dimension detected, a heater selector 24*c* selects a heater element that can cover the maximum dimension (width) of the dot image.

Figure 18:
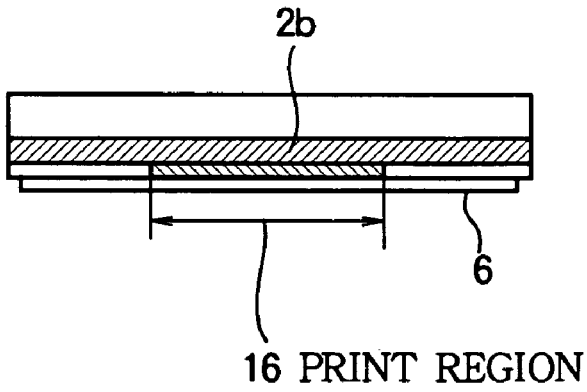
FIG. 18 illustrates a general configuration of the fourth embodiment.

FIG. 18 illustrates a general configuration of the fourth embodiment. When the toner image has a very small width compared to the print medium 6, the heater element is positioned such that the heater element opposes an area of print region 16 where the toner image will adhere to the print medium 6. Thus, heat will not transfer to areas outside the print region 16.

It is useless to supply heat to an area on the print medium 6 from which a toner image is absent. In the fourth embodiment, no heat is transferred to an area on the print medium 6 in which no toner image is transferred, thereby decreasing a total amount of heat generated to achieve power saving. Because heat is not supplied to an area on the print medium in which a toner image is absent, shortage of moisture in the print medium can be prevented. Therefore, when duplex printing is performed, the problems of poor transfer of toner images and temperature rise of the photoconductive drum can be alleviated.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing apparatus, comprising:

a magnetic flux generator that generates a magnetic flux;

a heater disposed in the magnetic flux and generating heat by electromagnetic induction to heat a developer on a print medium; and a selector that selects a dimension of said heater in accordance with a size of the print medium;

wherein said heater includes at least two heater elements having different lengths that extend in traversing directions substantially perpendicular to an advance direction in which the print medium is advanced;

wherein the size of the print medium is a width of the print medium that extends in the traversing direction; and wherein said selector selects one of the at least two heater elements in accordance with the width of the print medium.

2. A fixing apparatus, comprising:

a magnetic flux generator that generates a magnetic flux;

a heater disposed in the magnetic flux and generating heat by electromagnetic induction to heat a developer on a print medium;

a selector that selects a dimension of said heater in accordance with a size of the print medium; and a fixing member in the form of a hollow cylinder that rotates in contact with the print medium;

wherein said magnetic flux generator and said heater are disposed inside of the fixing member in such a way that said heater is between the fixing member and said magnetic flux generator.

3. The fixing apparatus according to claim 2, further comprising a pressurizing member formed of a non-magnetic, electrically conductive material;

wherein the pressurizing member opposes the fixing member in such a way that the print medium is held between the pressurizing member and the fixing member in a sandwiched relation.

4. A fixing apparatus, comprising:

a magnetic flux generator that generates a magnetic flux;

a heater disposed in the magnetic flux and generating heat by electromagnetic induction to heat a developer on a print medium; and a selector that selects a dimension of said heater in accordance with a size of the print medium;

wherein said heater is formed in a circumferential surface of a cylindrical rotating body that rotates about an axis substantially parallel to a traversing direction perpendicular to an advance direction in which the print medium is advanced;

wherein said heater has a dimension that extends in the traversing direction, the dimension monotonically changing along a circumferential direction of the cylindrical rotating body; and wherein said heater is supported on the rotating body by means of a non-magnetic, electrically conductive member.

5. The fixing apparatus according to claim 4, wherein a first current flows into said magnetic flux generator when said magnetic flux generator generates the magnetic flux, and a second current flows into said magnetic flux generator when said magnetic flux generator does not generate the magnetic flux; and wherein said heater is positioned relative to said magnetic flux generator in accordance with a difference between the first current and the second current.

6. The fixing apparatus according to claim 1, wherein when the developer is heated, the developer melts.

7. A printer having the fixing apparatus according to claim 1, the printer comprising:

a photoconductive drum;

a charging roller that rotates in contact with said photoconductive drum to charge a surface of said photoconductive drum;

an LED head that illuminates the charged surface of said photoconductive drum to form an electrostatic latent image on the charged surface;

a developing roller that rotates in contact with said photoconductive drum to develop the electrostatic latent image into a visible image; and a transfer roller that transfers the visible image onto the print medium;

wherein the print medium is advanced to the fixing apparatus after transfer of the visible image onto the print medium so that the visible image is fixed into a permanent image.

8. A fixing apparatus, comprising:

a magnetic flux generator that generates a magnetic flux;

a heater disposed in the magnetic flux and generating heat by electromagnetic induction to heat a toner image formed on a print medium; and a selector that selects a dimension of said heater in accordance with a size of the print medium;

wherein said selector selects the dimension of the heater element in such a way that a heat-generating portion of said heater extends across a width of a print region of the print medium in which the toner image should be printed, the heat-generating portion extending in a traversing direction substantially perpendicular to an advance direction in which the print medium is advanced;

wherein said heater includes at least two heater elements having different lengths that extend in the traversing direction; and wherein the size of the print medium is a width of the print medium that extends in the traversing direction and said selector selects one of the at least two heater elements in accordance with the width of the print region that extends in the traversing direction.

9. The fixing apparatus according to claim 2, wherein when the developer is heated, the developer melts.

10. A printer incorporating the fixing apparatus according to claim 8, the printer comprising:

a photoconductive drum;

a charging roller that rotates in contact with said photoconductive drum to charge a surface of said photoconductive drum;

an LED head that illuminates the charged surface of said photoconductive drum to form an electrostatic latent image on the charged surface;

a developing roller that rotates in contact with said photoconductive drum to develop the electrostatic latent image into the toner image; and a transfer roller that transfers the toner image onto the print medium;

wherein the print medium is advanced to the fixing apparatus after transfer of the toner image onto the print medium so that the toner image is fixed into a permanent image.

11. A printer incorporating the fixing apparatus according to claim 1, the printer comprising:

a driving mechanism that transports the print medium to said fixing apparatus, the print medium having a developer image formed on it;

wherein said heater fixes the developer image formed on the print medium by heat.

12. A printer incorporating the fixing apparatus according to claim 2, the printer comprising:

a driving mechanism that transports the print medium to said fixing apparatus, the print medium having a developer image formed on it;

wherein said heater fixes the developer image formed on the print medium by heat.

13. A printer incorporating the fixing apparatus according to claim 4, the printer comprising:

a driving mechanism that transports the print medium to said fixing apparatus, the print medium having a developer image formed on it;

wherein said heater fixes the developer image formed on the print medium by heat.

14. A printer incorporating the fixing apparatus according to claim 8, the printer comprising:

a driving mechanism that transports the print medium to said fixing apparatus, the print medium having the toner image formed on it;

wherein said heater fixes the toner image formed on the print medium by heat.

* * * * *